US011703208B1

(12) United States Patent
Hounsell

(10) Patent No.: US 11,703,208 B1
(45) Date of Patent: Jul. 18, 2023

(54) SYSTEM FOR MANIPULATING PERCEIVED MATERIAL COLOR AND PROCESS

(71) Applicant: Kyle Hounsell, North Billerica, MA (US)

(72) Inventor: Kyle Hounsell, North Billerica, MA (US)

( * ) Notice: Subject to any disclaimer, the term of this patent is extended or adjusted under 35 U.S.C. 154(b) by 0 days.

(21) Appl. No.: 17/884,563

(22) Filed: Aug. 10, 2022

(51) Int. Cl.

| | |
|---|---|
| ***F21V 9/40*** | (2018.01) |
| ***F21V 23/04*** | (2006.01) |
| *F21Y 115/10* | (2016.01) |
| *F21Y 113/10* | (2016.01) |

(52) U.S. Cl.
CPC ..... *F21V 9/40* (2018.02); *F21V 23/04* (2013.01); *F21Y 2113/10* (2016.08); *F21Y 2115/10* (2016.08)

(58) Field of Classification Search
CPC ..... F21V 9/40; F21V 23/04
See application file for complete search history.

(56) References Cited

U.S. PATENT DOCUMENTS

| | | | | |
|---|---|---|---|---|
| 2009/0079357 | A1* | 3/2009 | Shteynberg | H05B 45/37 315/291 |
| 2012/0306525 | A1* | 12/2012 | Mone | H02S 50/10 324/761.01 |
| 2015/0351190 | A1* | 12/2015 | Walters | H05B 45/28 315/186 |
| 2021/0256931 | A1* | 8/2021 | Davis | G02B 27/283 |
| 2021/0274083 | A1* | 9/2021 | Lorenz | H05B 47/155 |
| 2021/0360756 | A1* | 11/2021 | Gadegaard | H05B 47/155 |
| 2021/0386036 | A1* | 12/2021 | Broersma | A01K 41/02 |
| 2023/0003662 | A1* | 1/2023 | Ishii | G01N 21/8806 |

* cited by examiner

*Primary Examiner* — Christopher E Dunay
(74) *Attorney, Agent, or Firm* — Steven C. Stewart

(57) ABSTRACT

A method and apparatus to manipulate a perceived target material color by varying compositions of illumination with static perceived chromaticity is disclosed. An illumination source is configured to emit light at a first set of wavelengths with a first set of amplitudes to illuminate the target material. An observer perceives the emitted light to be at a predetermined chromaticity, and perceives light reflected from the illuminated target material to be at a first chromaticity. A control device switches the illumination source to emit light at a second plurality of wavelengths at a second plurality of amplitudes, which is perceived to the observer to be of the same predetermined chromaticity as before, while the light reflected from the illuminated target material is perceived to be of a different chromaticity.

19 Claims, 6 Drawing Sheets

300

SYSTEM FOR MANIPULATING PERCEIVED MATERIAL COLOR AND PROCESS

TECHNICAL FIELD

These claimed embodiments relate to manipulating a perceived material color and more particularly to manipulating a perceived target material color by varying compositions of illumination with static perceived chromaticity.

BACKGROUND OF THE INVENTION

Field of the Invention

A method and apparatus for manipulating perceived color of a target material is disclosed.

Description of Related Art

The human eye (as well as other color sensors, though potentially with different transfer functions) cannot distinguish between many different "compositions" (referring to the spectral content of light generated/selected/emitted in terms of its relative intensity versus wavelength) of light (white or colored) which, though perceived (to refer to perception either "by eye" or through an intermediate medium e.g. digital or analog image capture techniques) to have the same chromaticity (quality of color independent of brightness) in actuality have radically different spectral compositions. Many materials exhibit Transmission, Reflection, Absorption, and Fluorescence spectra (hereinafter referred to as T/R/NF spectra) with sharp peaks and/or troughs around specific wavelengths of light (hereinafter referred to as "peaky" T/R/NF) either static or time variant, due to the inherent chemical qualities of the material (e.g. the inherent bulk color of a dye or pigment), or due to qualities of the structure of the material (e.g. the color of light-interference based thin-film coatings or micro/nano-structures).

A trend of lighting manufacturers is to generate light with a high Color Rendering Index (CRI). Lights with low CRI and/or composed spectral emissions may produce exceedingly poor color rendering indices; however, the compositions should be selected to alternately avoid or target T/R/NF peaks or troughs in order to exhibit an effect of changing a material color appearance in contrast to lighting under conventional high CRI sources, or under other composed spectral emissions.

Examples changing the spectral composition of emitted light to effect the changes in the chromaticity of light reflected off of a material back to an observer is detailed by Murata, Bastron [of the United States Geological Survey (USGS)] article [Science Vol 123]. Murata details the use of unfiltered (predominantly light blue colored) mercury lamps to turn the mineral bastnaesite green as opposed to being perceived as brown under an incandescent (predominantly yellow colored) lamp.

BRIEF SUMMARY OF THE INVENTION

In some aspects, the techniques described herein relate to a system for manipulating a perceived chromaticity of a target material including an illumination source configured to have a first state in which light is emitted at a first plurality of wavelengths with a first plurality of amplitudes (hereinafter to include either analog continuous wave amplitude or Pulse Width Modulation [PWM] type duty cycle based average amplitude) to at least partially illuminate the target material, said emitted light perceived by an observer to be at a predetermined chromaticity, and light reflected from said at least partially illuminated target material perceived by an observer to be at a first chromaticity, a control device configured to feed a switch signal to said illumination source to switch said illumination source from the first state to a second state, and in response to said switch signal, said illumination source configured to switch to the second state in which the illumination source emits light at a second plurality of wavelengths at a second plurality of amplitudes, wherein at least one of the second plurality of wavelengths differ from the first plurality of wavelengths, or wherein at least one of the second plurality of wavelengths is identical to one of the first plurality of wavelengths with a different amplitude.

In some aspects, the techniques described herein relate to a system wherein the control device is configured to send the switch signal to said illumination source to switch from the first state to a second state in response to a manual switch.

In some aspects, the techniques described herein relate to a system wherein the control device is configured to send the switch signal to said illumination source to switch from the first state to a second state in response to an electronic controller.

In some aspects, the techniques described herein relate to a system wherein the illumination source includes a plurality of light emitting diodes.

In some aspects, the techniques described herein relate to a system wherein the illumination source includes at least one filter, lens or phosphor optically coupled with at least one of a plurality of light emitting diodes.

In some aspects, the techniques described herein relate to a system, wherein in response to the switch signal, the illumination source is configured to gradually switch the emitted light from the first state with the output luminosity having a first composed spectral profile to the second state with the output luminosity having a second composed spectral profile while maintaining a constant output luminosity on the target material.

In some aspects, the techniques described herein relate to a method for manipulating a perceived chromaticity of a target material including: emitting a light with an illumination source at a first plurality of wavelengths with a first plurality of amplitudes to at least partially illuminate the target material such that to an observer said light is perceived to be at a predetermined chromaticity and said illuminated target material is perceived to the observer to be at a first chromaticity; feeding a switch signal to said illumination source to switch at least one of a first plurality of wavelengths with a first plurality of amplitudes of the emitting light to at least one of a second plurality of wavelengths with a second plurality of amplitudes; and emitting light with the illumination source at the second plurality of wavelengths with the second plurality of wavelengths in response to said switch signal to at least partially illuminate the target material such that to the observer said light is perceived to be at the predetermined chromaticity and the illuminated target material is perceived to be at a second chromaticity different from the first chromaticity, wherein at least one of the second plurality of wavelengths a) differs from at least one of the first plurality of wavelengths, or b) is identical to at least one of the first plurality of wavelengths with a different amplitude.

In some aspects, the techniques described herein relate to a method, further including gradually switching light emitted from the illumination source with at least one of the first plurality of wavelengths with a first plurality of amplitudes to the second plurality of wavelengths with the second plurality of amplitudes while maintaining a constant output luminosity on the target material.

In some aspects, the techniques described herein relate to a computer readable storage medium including instructions which when executed by a processor includes: provide a signal to a controller to emit a light with an illumination source at a first plurality of wavelengths with a first plurality of amplitudes to at least partially illuminate a target material such that to an observer said light is perceived to be at a predetermined chromaticity and said illuminated target material is perceived to the observer to be at a first chromaticity; feed a switch signal to said illumination source to switch at least one of a first plurality of wavelengths with a first plurality of amplitudes of the emitting light to at least one of a second plurality of wavelengths with a second plurality of amplitudes; and feed a sign to emit light with the illumination source at the second plurality of wavelengths with the second plurality of amplitudes in response to said switch signal to at least partially illuminate the target material such that to the observer said light is perceived to be at the predetermined chromaticity and the illuminated target material is perceived to be at a second chromaticity different from the first chromaticity, wherein at least one of the second plurality of wavelengths a) differs from at least one of the first plurality of wavelengths, or b) is identical to at least one of the first plurality of wavelengths with a different amplitude.

In some aspects, the techniques described herein relate to a computer readable storage medium, wherein the processor provides instructions to gradually switching light emitted from the illumination source with at least one of the first plurality of wavelengths with a first plurality of amplitudes to the second plurality of wavelengths with the second plurality of amplitudes while maintaining a constant output luminosity on the target material.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different figures indicates similar or identical items.

FIG. 1A is a first state and FIG. 1B is a second state;

DETAILED DESCRIPTION

Figure 1A:
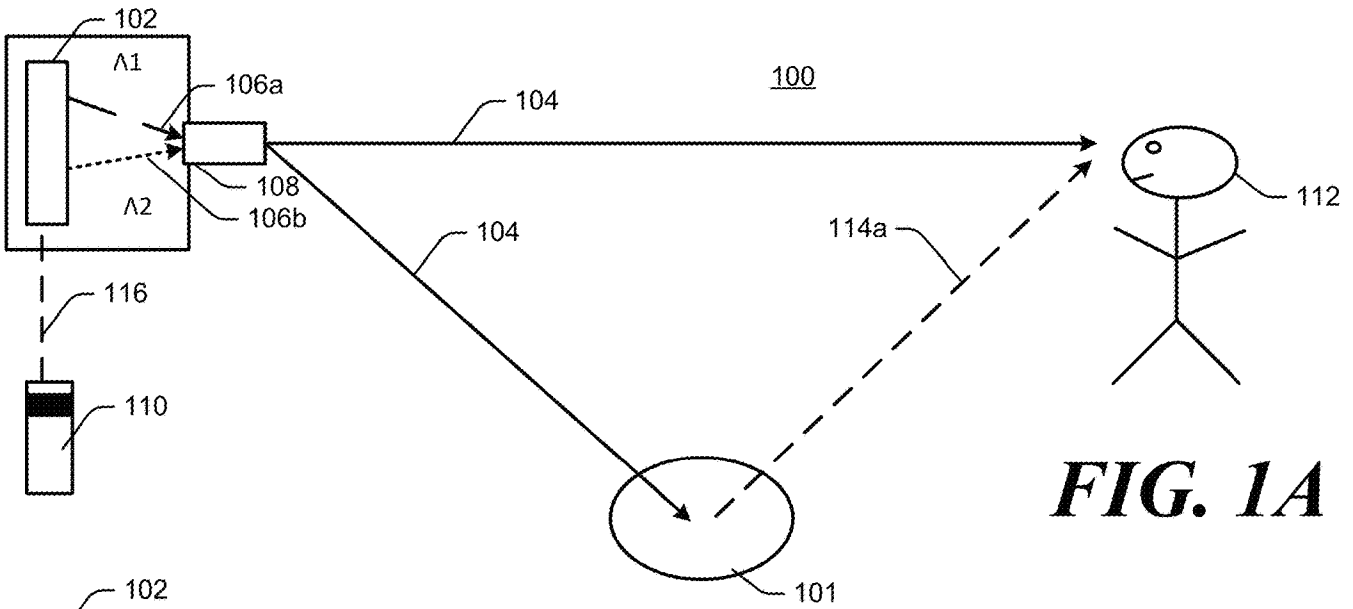
FIGS. 1A and 1B are a simplified schematic diagrams of a system for manipulating a perceived target material color by varying compositions of illumination with static perceived chromaticity, where
Figure 1B:
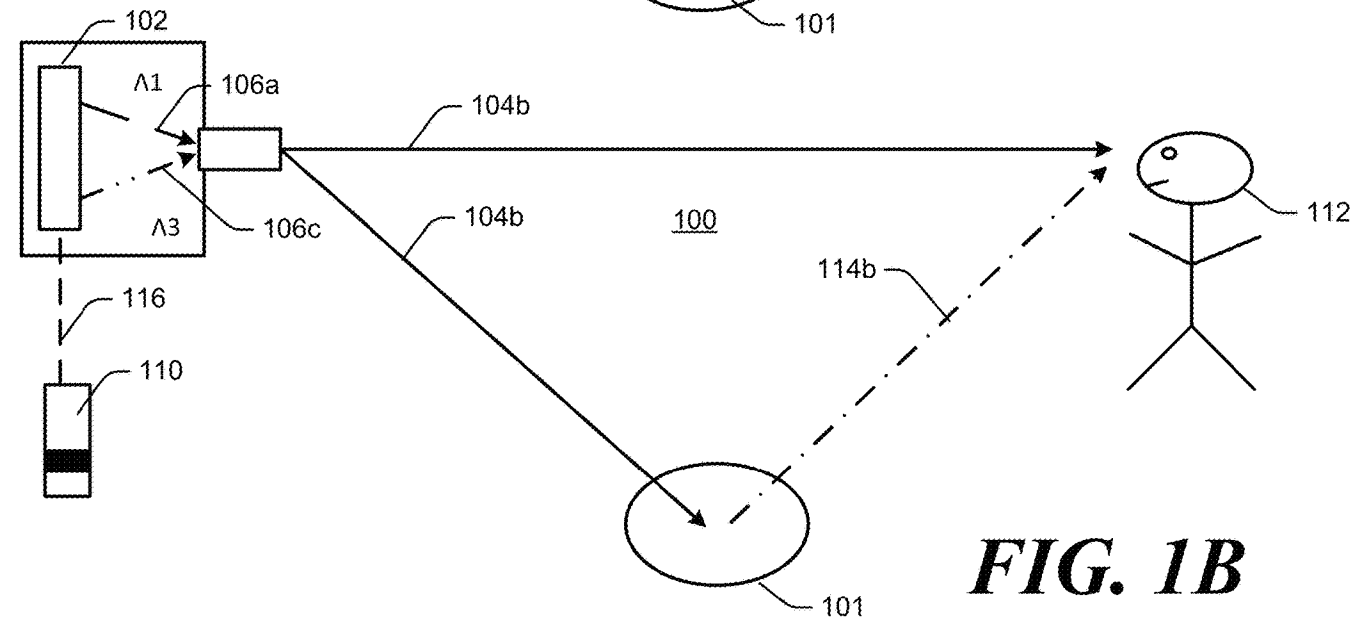

Referring to FIGS. 1A and 1B there is shown a system 100 for manipulating a perceived chromaticity of a target material 101. System 100 includes illumination source 102 emitting light at a wavelength of lambda 1 and wavelength lambda 2 (in FIG. 1A) and wavelength lambda 1 and lambda 3 (in FIG. 1B). In each composed spectral profile, each wavelength has a predetermined amplitude. Light emitted at a wavelength of lambda 1 and wavelength lambda 2, and wavelength lambda 1 and lambda 3 is fed via lens 108 as light 104 (FIG. 1A) or as light 104*b* (FIG. 1B) to both target material 101 and to observer 112. Exemplary illumination source 102 is shown in more detail in FIG. 3. Light 114*a* (FIG. 1A), and light 114*b* (FIG. 1B) is reflected off target material 101 and is perceived by observer 112. Observer 112 may be a human observer or may be any device or sensor capable of recognizing light, such as a photographic device or a camera.

Referring to FIG. 1A, Illumination source 102 is configured to have a first state in which light 104 is emitted at first wavelengths of light 106*a* and 106*b*. The first wavelengths of light 106*a* and 106*b* have first amplitudes that are fed through lens 108 to at least partially illuminate target material 101.

The emitted light 104 may be perceived by an observer 112 to be at a predetermined chromaticity. Light 114*a* reflected from the at least partially illuminated target material 101 may be perceived by an observer 112 to be at a first chromaticity.

A control device 110 feeds a switch signal 116 to the illumination source 102 to switch said illumination source 102 from the first state (FIG. 1A) to a second state (See FIG. 1B). In one implementation control device 110 is a manual switch having a first position as shown in FIG. 1A, or a second position as shown in FIG. 1B. In another implementation, control device 110 is an electronic controller such as a microprocessor.

The emitted light 104*b* may be perceived by an observer 112 to be at the predetermined chromaticity as light 104 in FIG. 1A. Light 114*b* reflected from the at least partially illuminated target material 101 may be perceived by an observer 112 to be at a second chromaticity.

Referring to FIGS. 1B and 1*n* response to the switch signal 116, the illumination source 102 switches to the second state in which the illumination source 102 emits light 106*a* and emits light 106*c* at a second plurality of wavelengths at a second plurality of amplitudes. Either at least one of the second plurality of wavelengths of light 106*c* differ from the first plurality of wavelengths of light 106*b*, or at least one of the second plurality of wavelengths of light 106*c* or light 106*a* is identical to one of the first plurality of wavelengths of light 106*b* or light 106*a* with a different amplitude.

In one implementation, in response to the switch signal 116, the illumination source 102 is configured to gradually switch the emitted light 104 from the first state with the illumination source output luminosity having a first composed spectral profile to the second state with the illumination source output luminosity of emitted light 104*b* having a second composed spectral profile while maintaining a constant output luminosity on the target material 101 as perceived by observer 112.

In another implementation, the first and second wavelengths and amplitudes of light from the illumination source may be configured based on information retrieved from a data store. Such information in the data store may be determined based on absorption characteristics of the target material as described herein in FIG. 4.

Example Hardware Architecture

Figure 2:
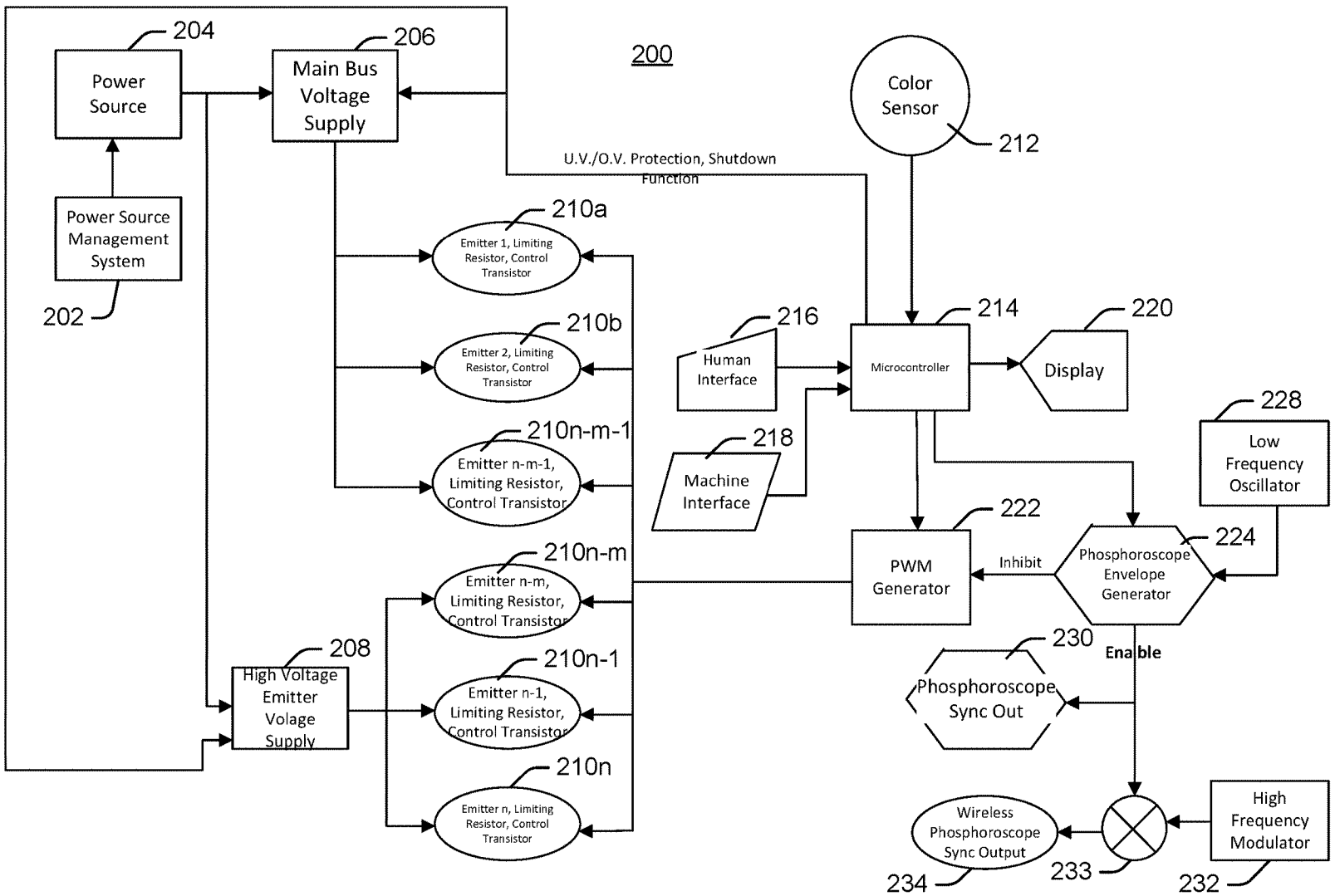
FIG. 2 is a simplified schematic diagram of a hardware for manipulating a perceived target material color by varying compositions of illumination with static perceived chromaticity.

Referring to FIG. 2, there is shown a hardware device 200 to manipulate a perceived target material color by varying compositions of illumination with static perceived chromaticity. Hardware device 200 includes a power source management subsystem 202 coupled to power source 204 that supplies power to a main bus voltage supply 206 and high voltage emitter voltage supply 208. Main bus voltage supply 206 is electrically coupled with and supplies power to light emitters 210*a*, 210*b* and 210*n*-*m*-1. High voltage emitter voltage supply 208 is electrically coupled with and supplies power to light emitters 210*n*-*m*, 210*n*-1 and 210*n*. Emitters 210*a*, 210*b*, 210*n*-*m*-1, 210*n*-*m*, 210*n*-1 and 210*n* are preferably limiting resistor, control transistor type. In one implementation there may be more or less low voltage emitters than high voltage emitters. The n and m notation are provided to indicate that there may be multiple low voltage emitters and high voltage emitters.

A microcontroller 214 (coupled with or having an internal memory, or computer readable storage medium in which instructions are stored) is coupled to and receives signals from a human interface device (such as a keyboard or touch display) 216, a machine interface device 218 (such as a remote control or universal serial bus (USB) cable), and color sensor 212. Color sensor 212 can directly detect colors of light from any external source.

Microcontroller 214 is coupled with and sends signals to display 220, (such as an LED, LCD or Organic Light-Emitting Diode (OLED) display), Pulse width modulator (PWM) generator 222 and phosphoroscope envelope generator 224. Pulse width modulator generator 222 provides signals to enable and set the amplitude of colors emanating from light emitters 210*a*, 210*b*, 210*n*-*m*-1, 210*n*-*m*, 210*n*-1 and 210*n*.

Phosphoroscope envelope generator 224 receives a timing signal from low frequency oscillator 228, inhibits PWM generator 222 and is coupled with and enables phosphoroscope synchronization out 230. The output of pulse width modulator generator 222 in response to the inhibit signal from phosphoroscope envelope generator 224 and control signals from microcontroller 214 is fed to light emitters 210*a*, 210*b*, 210*n*-*m*-1 210*n*-*m*, 210*n*-1 and 210*n*.

The inhibit signal from phosphoroscope envelope generator 224 is combined via combiner 233 with oscillations from high frequency modulator 232 and is fed to wireless phosphoroscope synchronization output 234.

Figure 3:
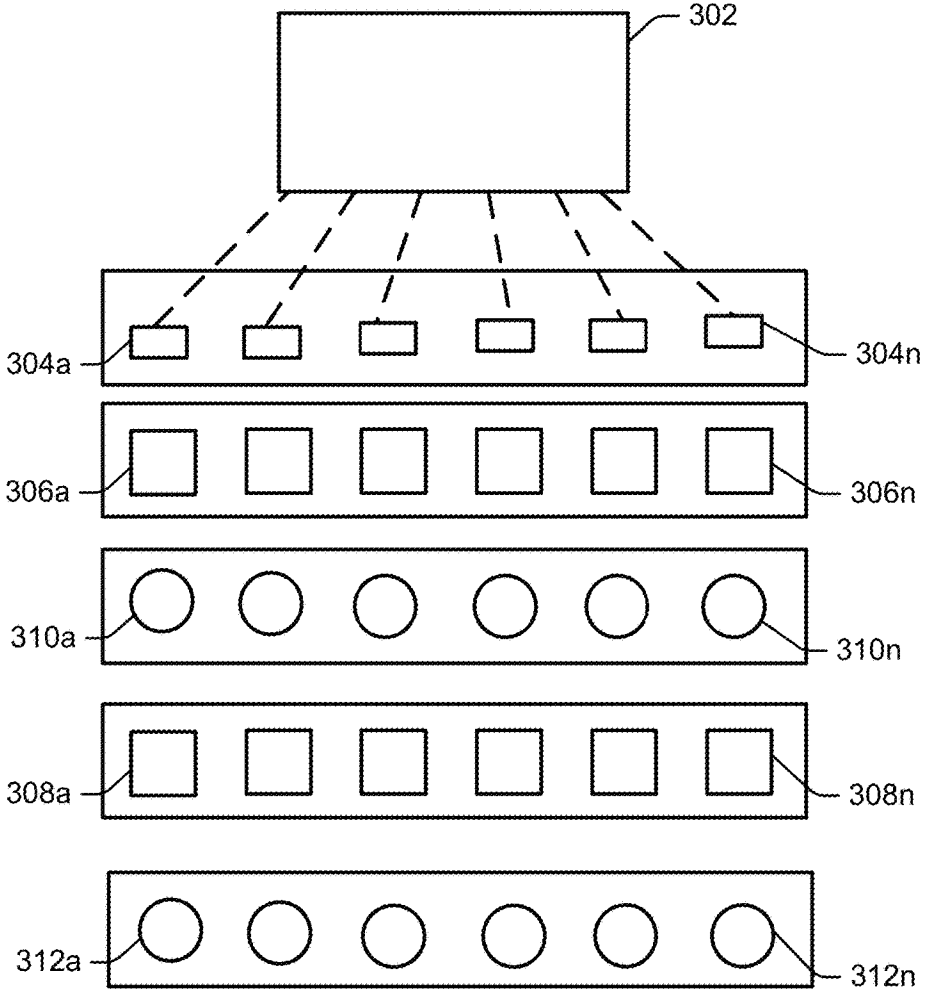
FIG. 3 is top-down cross section view of a device for manipulating a perceived target material color by varying compositions of illumination with static perceived chromaticity using the hardware of FIG. 2.

In FIG. 3 there is illustrated a device 300 for manipulating a perceived target material color by varying compositions of illumination with static perceived chromaticity using the hardware of FIG. 2. Device 300 includes power regulation and control subsystem 302 (subsystem 202 in FIG. 2) electrically coupled to light emitters 304*a*-304*n* (light emitters 210*a*, 210*b*, 210*n*-*m*-1 210*n*-*m*, 210*n*-1 and 210*n*). Exemplary light emitters 304*a*-304*n* include light emitting diodes (LEDs), laser transmitters, high or low intensity light bulbs and may have controllable intensity. Light emitters 304*a*-304*n* may be optically coupled via spectrum modifiers 306*a*-306*n* and 308*a*-308*n* (e.g., phosphors, bandpass filters, band stop filters high pass filters, low pass filters and absorptive filters) to optical path modifiers 310*a*-310*n*, and 312*a*-312*n* (e.g., lenses. diffusers and/or light guides). Light emitters 304*a*-304*n*, spectrum modifiers 306*a*-306*n* and 308*a*-308*n* and optical path modifiers 310*a*-310*n*, and 312*a*-312*n* may be enabled and disabled independently by microcontroller 214 to enable device 300 to emit light as described in connection with FIG. 5.

Figure 4:
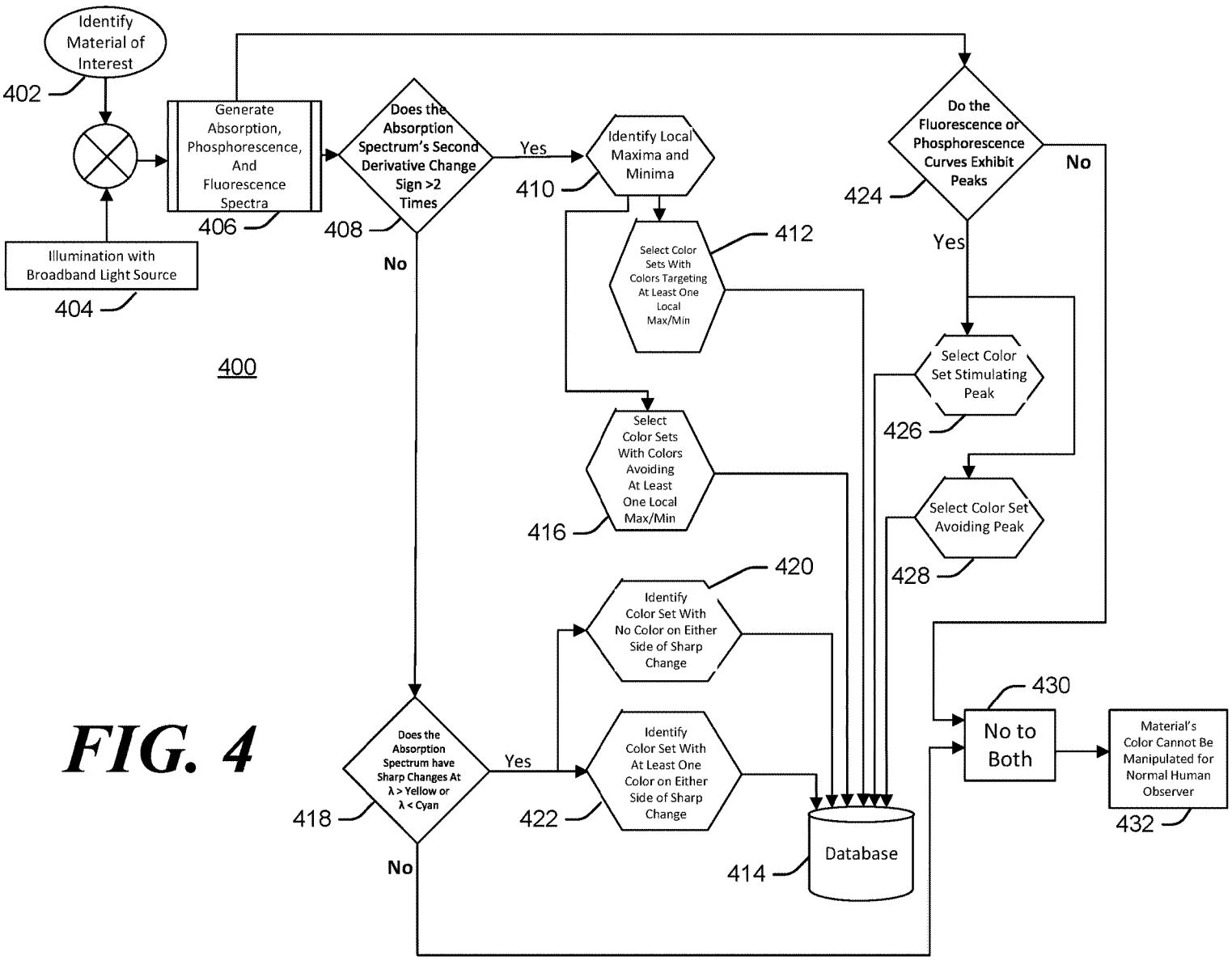
FIG. 4 is a flow diagram of a process for determining the reflectivity curves for a material of interest using the hardware and device of FIGS. 2 and 3.
Figure 5:
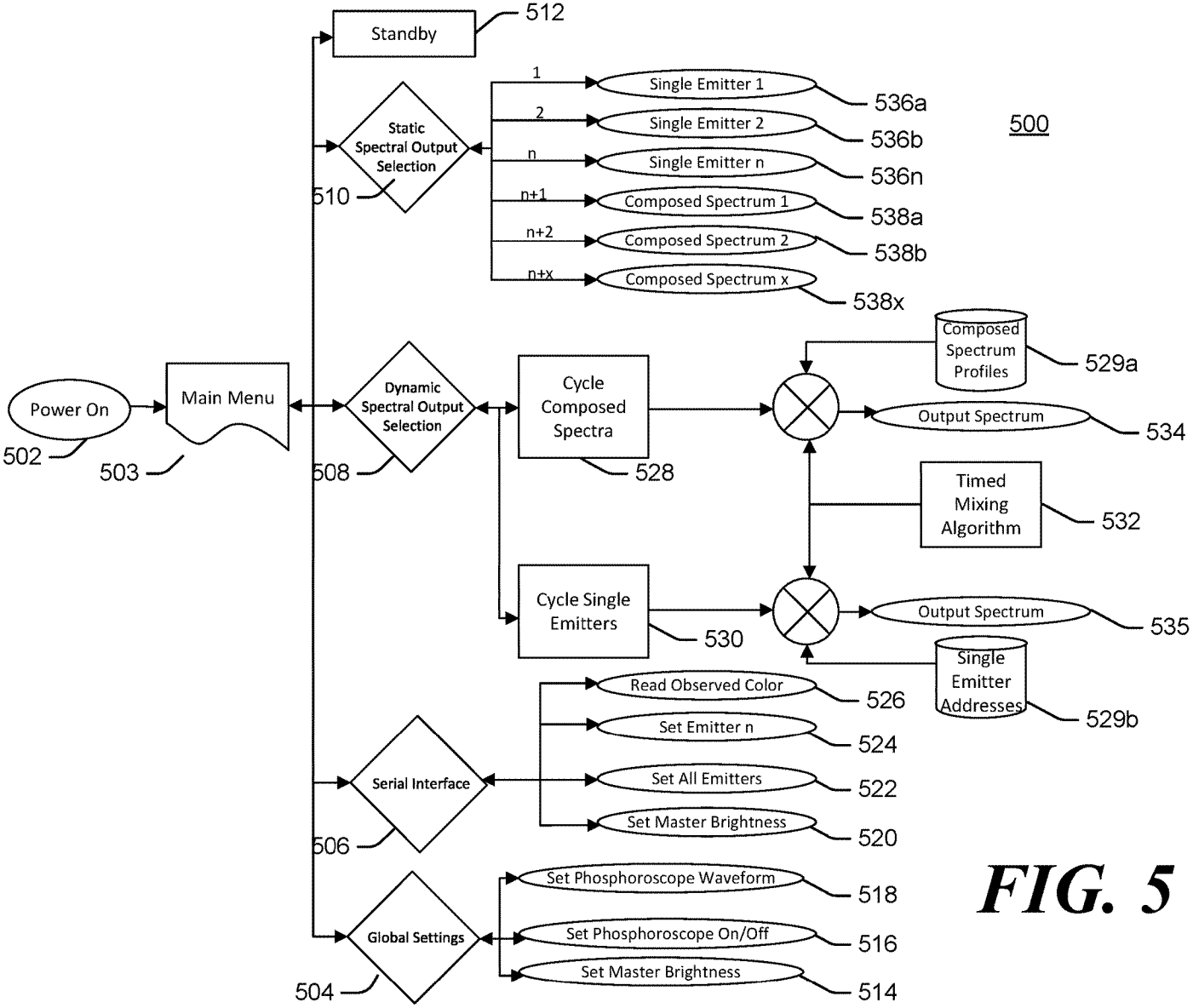
FIG. 5 is a flow diagram of the process for manipulating a perceived target material color by varying compositions of illumination with static perceived chromaticity.

Illustrated in FIG. 4 is a process 400 (or method) for determining and storing absorption of a target material. Illustrated in FIG. 5 is a process 500 (or method) for manipulating a perceived target material color by varying compositions of illumination with static perceived chromaticity. The exemplary process in FIG. 4 and FIG. 5 is illustrated as a collection of blocks in a logical flow diagram, which represents a sequence of operations that can be implemented in hardware, software, manually, and a combination thereof. In the context of software, the blocks represent computer-executable instructions that, when executed by one or more processors, perform the recited operations. Generally, computer-executable instructions may be stored in a computer readable medium and include routines, programs, objects, components, data structures, and the like that perform particular functions or implement particular abstract data types. The order in which the operations are described is not intended to be construed as a limitation, and any number of the described blocks can be combined in any order and/or in parallel to implement the process. For discussion purposes, the processes are described with reference to FIGS. 4 and 5, although it may be implemented in other system architectures.

Referring to FIG. 4, a process 400 is shown for determining process for determining the reflectivity curves for a material of interest using the hardware device 200 of FIGS. 2 and 3. The device 200 uses the microprocessor and modules shown in FIG. 2.

In the process, a material of interest (target material) is identified (FIG. 4) in block 402. Simultaneously in block 404, a broadband light source is generated.

In block 406, absorption, phosphorescence, and florescence spectra are generated from the light source projected on the material of interest. Then block 408 and block 424 is processed.

In block 408, a determination is made whether the absorption spectrum's second derivative changes sign greater than twice.

If it is, in block 410 the local maxima and minima are identified. In block 412, set colors are selected that target at least one local maximum or minimum. Such color sets are then stored in a database or data store 414. In block 416, colors sets are selected with colors according to at least one local minimum and maximum and stored in data store 414.

If in block 408 a determination is made that the absorption spectrum, second derivative does not change sign more than twice, then block 418 is processed. In block 418, a determination is made whether the absorption spectrum has sharp changes at wavelengths longer than yellow or wavelengths shorter than cyan. If the determination from block 418 Is positive, in block 420 a color set is identified with no color or either side of sharp change and stored in data store 414. Further in block 422, the color set is identified with at least one color on either side of sharp change with the results stored in data store 414.

In block 424, a determination is made whether the fluorescence or phosphorescence curves exhibit peaks. If they exhibit peaks, a color set stimulating one or more peak is selected in block 426 and stored in data store 414. Also a color set avoiding peaks is selected in block 428 and the set is stored in the data store 414.

If in the determination is made in block 424 that the fluorescence or phosphorescence curves do not exhibit peaks and the determination is made in block 418 that the absorption spectrum does not have sharp changes at wavelengths longer than yellow or wavelengths shorter than cyan then in block 430 and block 432 an indication is provided that the materials color cannot be manipulated for an observer (in the current example, a normal human observer—other types of observers may shift the rules regarding the yellow/cyan cutoffs).

Referring to FIG. 5, a process 500 is shown for manipulating a perceived target material color by varying compositions of illumination with static perceived chromaticity using the hardware device 200 of FIGS. 2 and 3. The device 200 uses the microprocessor and modules shown in FIG. 2.

In the process, the device 200 is powered on in block 502, and displays a main menu in block 503.

On the main menu, a user selects one of a global setting block 504, a serial interface block 506, dynamic spectral selection block 508, a static spectral output selection block 510, or stand by block 512.

If the user selects global setting block 504 option, in block 514 the user sets the master brightness of the light from the source, in block 516. The user may also set the phosphoroscope on or off, or in block 518 sets the phosphoroscope waveform.

If the user selects the serial interface block 506, the user has the option of setting the master brightness in block 520, setting all emitters in block 522, setting a specific emitter in block 524, or setting the read observed color in block 526.

If the user selects the dynamic spectral selection block 508, the user has the option of selecting a cycle composed Spectra block 528 or a cycle single emitter block 530. If the cycle composed Spectra block 528 is selected, two composed spectral profiles for the target material are retrieved from the data store 529*a* (data store 414 of FIG. 4) and transitioned between with a timing mixed variable from block 532. The output spectrum is then composed using the cycle composed spectra from spectra block 528, the composed spectrum profiles from data store 529*a* and the timed mixing algorithm from block 532 and fed to set the light source in block 534. If the cycle single emitter block 530 is selected, two single emitter addresses for the target material are retrieved from the data store 529*b* (data store 414 of FIG. 2) and transitioned between with a timing mixed variable from block 532. Instructions in block 530 may gradually switch the emitted light from the first state with the illumination source output luminosity having a first composed spectral profile to the second state with the illumination source output luminosity of emitted light having a second composed spectral profile while maintaining a constant output luminosity on the target material 101 as perceived by an observer.

The output spectrum is then composed using the single emitter address profiles from data store 529*b*, the cycle single emitters from block 530 and the timed mixing algorithm from block 532 and fed to set the light source in block 535.

If the user selects the static spectral output selection block 510, the user has the option of selecting single emitter block 1 536*a*, single emitter block 2 536*b*, single emitter block n 536*n*, composed spectrum block 1 538*a*, composed spectrum block 2 538*b*, composed spectrum block x 538*x*. Selecting the single emitter blocks turns on specific emitters in the light source and selecting composed spectrum blocks turns on a predetermined spectrum and amplitudes from the various emitters in the light source.

Figure 6:
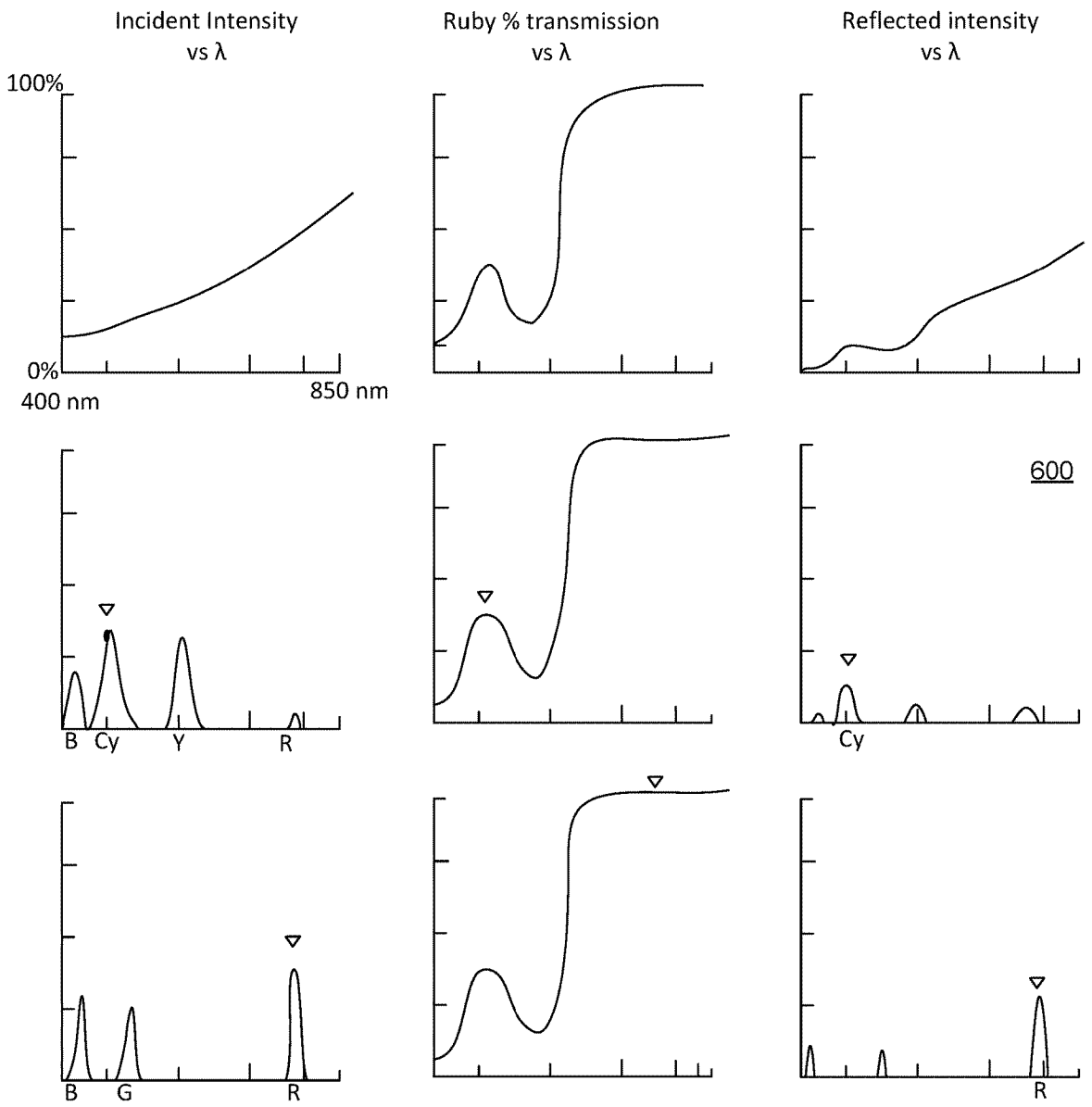
FIG. 6 is an exemplary chart showing various reflected intensity of light in response to incident intensity vs wavelength (lambda) with a specific transmission of a ruby in response to wavelength.

Referring to FIG. 6 there is shown an exemplary chart 600 showing various reflected intensity of light in response to incident intensity over a wavelength (denoted by the symbol A [lambda] and measured in nanometers) curve with a specific transmission of a ruby (exemplary target material) in response to the wavelength curve. Column 1 shows exemplary incident intensity of the light source as a function of wavelength, column 2 shows a ruby percent transmission as a function of wavelength, and column shows a reflected intensity from the ruby as a function of wavelength for the incident intensity shown in column 1. It is thus illustrated that to a normal human observer, a ruby appears to be red when illuminated by the top and bottom incident composed spectra, but purple to cyan when illuminated by the middle-composed spectrum.

While the above detailed description has shown, described and identified several novel features of the invention as applied to a preferred embodiment, it will be understood that various omissions, substitutions and changes in the form and details of the described embodiments may be made by those skilled in the art without departing from the spirit of the invention. Accordingly, the scope of the invention should not be limited to the foregoing discussion, but should be defined by the appended claims.

What is claimed is:

1. A system for manipulating a perceived chromaticity of a 3-dimensional target material comprising:

an illumination source configured to have a first state in which light is a) emitted by the illumination source at a first plurality of wavelengths with a first plurality of amplitudes to at least partially illuminate multiple points on different planes of the 3-dimensional target material, b) perceived by an observer to be directly emitted from the illumination source at a predetermined chromaticity, and c) perceived by the observer to at least partially illuminate multiple points on different planes of the 3-dimensional target material at a first chromaticity;

a control device configured to feed a switch signal to the illumination source to switch the illumination source from the first state to a second state;

in response to said switch signal, the illumination source configured to switch to the second state in which light is a) emitted by the illumination source at a second plurality of wavelengths with a second plurality of amplitudes to at least partially illuminate multiple points on different planes of the 3-dimensional target material, b) perceived by the observer to be directly emitted from the illumination source at the predetermined chromaticity, and c) perceived by the observer to at least partially illuminate multiple points on different planes of the 3-dimensional target material at a second chromaticity, wherein at least one of the second plurality of wavelengths differ from the first plurality of wavelengths, or wherein at least one of the second plurality of wavelengths is identical to one of the first plurality of wavelengths with a different amplitude, and wherein the multiple points on different planes of the 3-dimensional target material at the first chromaticity is perceived by the observer to be different from the multiple points on different planes of the 3-dimensional target material at the second chromaticity, and wherein the multiple points on different planes of the 3-dimensional target material at the second chromaticity is perceived by the observer to be different from the predetermined chromaticity.

2. The system as recited in claim 1 wherein the control device is configured to send the switch signal to said illumination source to switch from the first state to a second state in response to a manual switch.

3. The system as recited in claim 1 wherein the control device is configured to send the switch signal to said illumination source to switch from the first state to a second state in response to a signal from an electronic controller.

4. The system as recited in claim 1 wherein the illumination source includes a plurality of light emitting diodes.

5. The system as recited in claim 4 wherein the illumination source includes at least one of a filter, phosphor, or lens optically coupled with at least one of a plurality of light emitting diodes.

6. The system as recited in claim 1, wherein in response to the switch signal, the illumination source is configured to transition the emitted light from the first state with the light being emitted having a first composed spectral profile to the second state with the light being emitted having a second composed spectral profile while maintaining a constant output luminosity on the multiple points on different planes of the 3-dimensional the target material.

7. The system as recited in claim 1 wherein the observer is at least one of a photographic device or a camera.

8. The system as recited in claim 1 wherein the illumination source is configured to emit light having frequencies outside of visual frequencies observable by an ordinary human so that the first chromaticity outside a chromaticity range visible to an ordinary human would be perceived by a photographic device to be different from the second chromaticity outside the chromaticity range visible to an ordinary human, and that the second chromaticity would be perceived by the photographic device outside the visual frequencies observable by the ordinary human to be different from the predetermined chromaticity.

9. The system as recited in claim 1 wherein the illumination source is configured to emit light at the first plurality of wavelengths with the first plurality of amplitudes to at least partially illuminate the target material such that light is reflected or emitted from the 3-dimensional target material at the first chromaticity, and wherein the illumination source is configured to emit light at the second plurality of wavelengths with the plurality of amplitudes to at least partially illuminate the 3-dimensional target material such that light is reflected or emitted from the 3-dimensional target material at the second chromaticity, the first plurality of wavelengths and the first plurality of amplitudes to cause light to be reflected or emitted from the 3-dimensional target material at the first chromaticity and the second plurality of wavelengths and the second plurality of amplitudes to cause light to be reflected or emitted from the 3-dimensional target material at the second chromaticity determined based on chromaticity information of the 3-dimensional target material retrieved from a data store.

10. The system as recited in claim 9 wherein the chromaticity information retrieved from the data store is determined based on absorption, transmission, reflection or fluorescence characteristics of the 3-dimensional target material that result in light being reflected or emitted from locations at different planes of the 3-dimensional target material at the first chromaticity and the second chromaticity.

11. The system as recited in claim 9, wherein the second plurality of amplitudes that cause light to be reflected or emitted from the 3-dimensional target material at the second chromaticity is determined based on chromaticity information of the 3-dimensional target material outside a visual range of an ordinary human retrieved from the data store.

12. The system as recited in claim 1, wherein the illumination source is configured to emit light having frequencies outside of visual frequencies observable by an ordinary human so that the first chromaticity outside the chromaticity range visible to an ordinary human would be perceived by the observer to be different from the second chromaticity outside the chromaticity range visible to an ordinary human, and wherein the observer has a different chromaticity discrimination function than a normal human observer.

13. The system as recited in claim 1, wherein the target material is a natural material, a synthetic material, or a gemstone.

14. A method for manipulating a perceived chromaticity of a 3-dimensional target material comprising:

emitting a light with an illumination source at a first plurality of wavelengths with a first plurality of amplitudes to illuminate multiple points in different planes on the 3-dimensional target material such that to an observer the light is perceived to be at a predetermined chromaticity and the illuminated multiple points in different planes on the 3-dimensional target material is perceived to the observer to be at a first chromaticity;

feeding a switch signal to said illumination source to switch at least one of a first plurality of wavelengths with a first plurality of amplitudes of the emitted light to at least one of a second plurality of wavelengths with a second plurality of amplitudes; and emitting light with the illumination source at the second plurality of wavelengths with the second plurality of amplitudes in response to said switch signal to illuminate the multiple points in different planes on the 3-dimensional target material such that to the observer said light is perceived to be at the predetermined chromaticity and the illuminated multiple points in different planes on the 3-dimensional target material is perceived to be at a second chromaticity different from the first chromaticity, wherein at least one of the second plurality of wavelengths a) differs from at least one of the first plurality of wavelengths, or b) is identical to at least one of the first plurality of wavelengths with a different amplitude.

15. The method as recited in claim 14, further comprising transitioning light emitted from the illumination source with at least one of the first plurality of wavelengths with a first plurality of amplitudes to the second plurality of wavelengths with the second plurality of amplitudes while maintaining a constant output luminosity on the multiple points in different planes on the 3-dimensional target material.

16. The method as recited in claim 14 further comprising emitting light at the first plurality of wavelengths with the first plurality of amplitudes to illuminate the multiple points in different planes on the 3-dimensional target material, and emitting light at the second plurality of wavelengths with the plurality of amplitudes to at least partially illuminate the multiple points in different planes on the 3-dimensional target material based on information retrieved from a data store and was determined based on absorption, transmission, reflection and fluorescence characteristics of the 3-dimensional target material outside an ordinary human range of vision.

17. The method as recited in claim 14 further comprising:

determining a first target material characteristic information based on the target material and chromaticity discrimination characteristics of a first observer;

determining a second target material characteristic information based on the target material and chromaticity discrimination characteristics of a second observer, wherein the first target material characteristic information is different from the second target material characteristic information;

storing the first target material characteristic information and second target material characteristic information in a datastore;

providing an indication whether the observer is the first observer or the second observer;

emitting light at the first plurality of wavelengths with the first plurality of amplitudes to illuminate the multiple points in different planes on the 3-dimensional target material, and emitting light at the second plurality of wavelengths with the plurality of amplitudes to at least partially illuminate the multiple points in different planes on the 3-dimensional target material based on first target material characteristic information retrieved from a data store or second target material characteristic information selected in response to the indication whether the observer is the first observer or the second observer respectively.

18. A non-transitory computer readable storage medium storing instructions configured to perform a method of manipulating a perceived chromaticity of a 3-dimensional target material, the method comprising:

providing a signal to a controller to cause mission of a first light with an illumination source at a first plurality of wavelengths with a first plurality of amplitudes to illuminate a-multiple points on different planes of the 3-dimensional target material such that to an observer said first light is perceived to be at a predetermined chromaticity and said illuminated multiple points on different planes of the 3-dimensional target material is perceived to the observer to be at a first chromaticity;

feeding a switch signal to said illumination source to switch at least one of a first plurality of wavelengths with a first plurality of amplitudes of the first light to a second light having at least one of a second plurality of wavelengths with a second plurality of amplitudes; and in response to said switch signal, emitting the second light with the illumination source at the second plurality of wavelengths with the second plurality of amplitudes to illuminate multiple points on different planes of the 3-dimensional target material such that to the observer said second light is perceived to be at the predetermined chromaticity and the illuminated multiple points on different planes of the 3-dimensional target material is perceived to be at a second chromaticity different from the first chromaticity, wherein at least one of the second plurality of wavelengths a) differs from at least one of the first plurality of wavelengths, or b) is identical to at least one of the first plurality of wavelengths with a different amplitude.

19. The non-transitory computer readable storage medium as recited in claim 18, wherein the method comprises:

gradually switching the first light emitted from the illumination source with at least one of the first plurality of wavelengths with a first plurality of amplitudes to the second light emitted with the second plurality of wavelengths with the second plurality of amplitudes while maintaining a constant output luminosity on multiple points on different planes of the 3-dimensional target material.

* * * * *